US006454583B2

(12) United States Patent
Lepine et al.

(10) Patent No.: US 6,454,583 B2
(45) Date of Patent: Sep. 24, 2002

(54) PNEUMATIC DISTRIBUTORS HAVING A COMMON PNEUMATIC-ELECTRICAL CONNECTOR BASE

(75) Inventors: Michel Lepine, Gif sur Yvette; Yannick Guenard, Houilles; Boualem Meziane, Argenteuil, all of (FR)

(73) Assignee: ASCO Joucomatic, Rueil Malmaison (FR)

( * ) Notice: Subject to any disclaimer, the term of this patent is extended or adjusted under 35 U.S.C. 154(b) by 0 days.

(21) Appl. No.: 09/899,849

(22) Filed: Jul. 9, 2001

(30) Foreign Application Priority Data

Jul. 26, 2000 (FR) ..... 00 09789

(51) Int. Cl.[7] ..... H01R 4/60

(52) U.S. Cl. ..... 439/191; 439/638; 439/652; 285/120.1; 285/124.1

(58) Field of Search ..... 439/190, 191, 439/638, 652; 285/120.1, 124.1

(56) References Cited

U.S. PATENT DOCUMENTS 4,469,128 A * 9/1984 Petrimaux et al. ..... 137/554
4,507,707 A * 3/1985 Willis ..... 361/380
4,648,682 A * 3/1987 Tubbs ..... 339/154
4,925,393 A * 5/1990 Ingalsbe ..... 439/76
5,340,331 A * 8/1994 Bohlen et al. ..... 439/502
5,807,140 A * 9/1998 Hopkins ..... 439/638

* cited by examiner

*Primary Examiner*—Tho D. Ta
*Assistant Examiner*—Truc Nguyen
(74) *Attorney, Agent, or Firm*—Connolly Bove Lodge & Hutz LLP

(57) ABSTRACT

A Modular assembly or islet for pneumatic distribution which comprises a number of modules or blocks each consisting of a slice and each incorporating pneumatic connectors and electrical connectors. Two pneumatic distributors are mounted at 90° to one another on two adjacent sides of the block or module so that the pneumatic connectors and the electrical connectors are common to the two distributors. The blocks or modules, with their respective pairs of distributors, are removably mounted on the connectors so as to assemble them side by side, thus constituting the modular assembly or islet for distribution with the desired number of pneumatic distributors.

3 Claims, 1 Drawing Sheet

PNEUMATIC DISTRIBUTORS HAVING A COMMON PNEUMATIC-ELECTRICAL CONNECTOR BASE

FIELD OF THE INVENTION

The present invention relates to pneumatic distribution systems consisting of an assembly of pneumatic distributors known by the name of pneumatic distribution islets.

BACKGROUND OF THE INVENTION

Modular pneumatic distribution assemblies comprising a number of modules each formed of a pneumatic distributor fixed to a base which comprises at least one common exhaust channel, this base being fixed to an adjacent base, are known (EP-A-0959280).

BACKGROUND OF THE INVENTION

Starting off from this state of the art, the present invention sets out to produce modular pneumatic distribution assemblies or pneumatic distribution islets designed in such a way as to be able to save space, particularly in terms of thickness, by a factor of at least two by comparison with the known modular inserts and in which the pneumatic or electrical connections needed for the distributors is or are reduced.

In consequence, a subject of this invention is a modular assembly for pneumatic distribution or islet for pneumatic distribution, characterized in that it comprises a number of modules or blocks each constituting a slice and each incorporating, on the one hand, pneumatic connectors and, on the other hand, electrical connectors, two pneumatic distributors being mounted at 90° to one another on two adjacent sides of the said block or module so that the said pneumatic connectors and the said electrical connectors are common to the two distributors, the said blocks or modules with their respective pairs of distributors being mounted, removably, on the said connectors so as to assemble them side by side, thus constituting the said modular assembly or islet for distribution, comprising the desired number of pneumatic distributors.

According to the invention, it is possible to mount distributors with different sizes, particularly different thicknesses, on pneumatic and electric bases of different sizes.

Other features and advantages of this invention will become apparent from the description given hereinafter with reference to the appended drawing which illustrates one entirely non-limiting exemplary embodiment thereof. In the drawing:

DETAILED DESCRIPTION OF THE INVENTION

Figure 2:
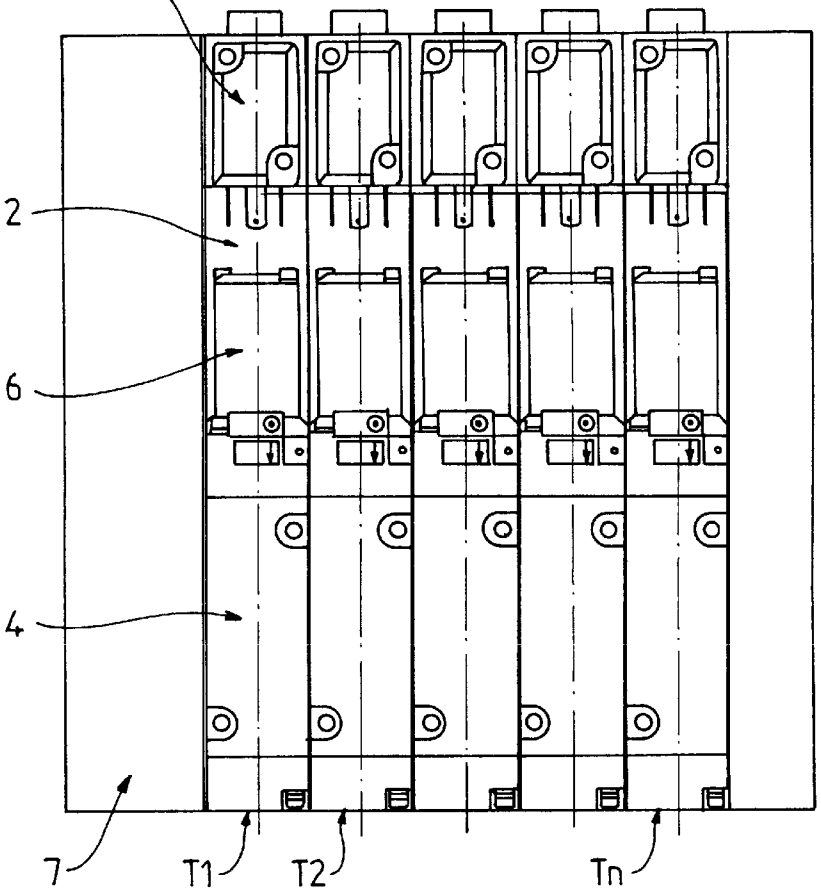
FIG. 2 is an end-on view of FIG. 1.

Referring to the drawing, it can be seen that a modular pneumatic distribution assembly according to the present invention consists of the side-by-side assembly of a number of slices such as T1, T2, . . . Tn, mounted one beside the other. Each slice comprises an individual block incorporating at least one base consisting of pneumatic connectors 1 with their pressure and exhaust channels and electrical connectors 2.

Of course, it is possible to envisage for each slice to comprise an individual block incorporating two bases, one of them being intended for pneumatic connections and the other for electrical connections.

Figure 1:
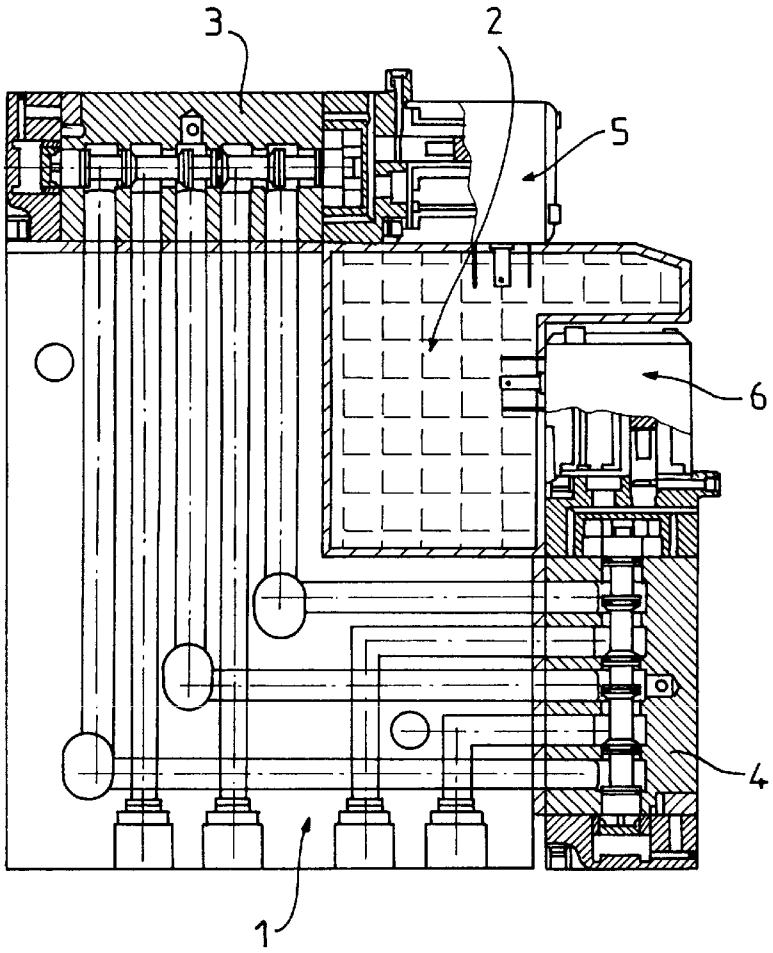
FIG. 1 is a view in side elevation of a distribution modular assembly or islet according to the invention.

Two pneumatic distributors 3 and 4 are mounted at 90° from one another on two adjacent sides of the said block so as to rest against the said pneumatic 1 and electrical 2 connectors common to the two distributors as can clearly be seen in FIG. 1. In this Figure, 5 and 6 have been used to depict the electromagnetic drivers of the distributors 3 and 4 respectively. By virtue of this characteristic set up of the invention, the unit incorporating the pneumatic 1 and electrical 2 connectors constitutes the pneumatic and electrical interface for the islet or module.

According to one advantageous feature of the invention, each slice (T1, T2, . . . Tn) can accommodate a number of pairs of pneumatic distributors (3,4). For example, it is possible to provide slices accommodating 2, 4, 6, 8, . . . pneumatic distributors.

FIG. 2 clearly demonstrates the particularly compact nature of the modular assembly produced according to the invention, the slices T1, T2, . . . Tn being mounted between connection fittings 7 supporting the pneumatic supply and exhaust, and the electrical connections providing connection to a control system.

The invention allows modules or slices T1, . . . Tn which may comprise distributors of different dimensions, particularly different thicknesses, to be joined together.

The distributors can be removed individually without there being a need for the pneumatic and electrical connections to be disconnected from the block that constitutes the common base holding the distributors.

Among the advantages afforded by the invention, particularly in comparison with the state of the art, mention may be made of:

- the significant space saving (in terms of thickness), of the order of a factor of 2 or more depending on the number of pairs of distributors assembled on each slice;
- the saving on electrical and pneumatic connectors, given that these connectors are common to the two distributors of any given slice;
- the performing of two functions in the same slice, that is to say within the same thickness;
- the possibility of changing a distributor on one and the same base, without altering the connections, in order to obtain a different function;
- the possibility of mounting distributors of different sizes on bases of different sizes;
- the high number of common parts for the pneumatic and electrical connections, and
- the significant cost saving.

It of course remains obvious that this invention is not restricted to the exemplary embodiment described and depicted but that it encompasses all variants thereof.

What is claimed is:

1. Modular assembly or islet for pneumatic distribution comprising:

- a plurality of adjacently stacked connector blocks, each block having electrical and pneumatic connectors incorporated therein;
- at least one pair of pneumatic distributors removably connected perpendicularly on two adjacent sides of each block and communicating with the pneumatic connectors therein when the distributors are connected to the block;

each distributor having an integral electrical driver that is connected to the connectors of the block simultaneous with pneumatic connections of the distributors.

2. Modular assembly according to claim 1, wherein the distributors have different dimensions.

3. A modular assembly according to claim 1, wherein each block can accommodate a number of pairs of pneumatic distributors.

* * * * *